United States Patent [19]

Lemire

[11] Patent Number: 4,951,406

[45] Date of Patent: Aug. 28, 1990

[54] ILLUMINATED SIGN FOR RESIDENCE STREET ADDRESS

[76] Inventor: Honoré M. Lemire, 3685, Châteaufort, Longueuil, Quebec, Canada, J4L 4A1

[21] Appl. No.: 207,962

[22] Filed: Jun. 17, 1988

[51] Int. Cl.[5] ..... G09F 13/04

[52] U.S. Cl. ..... 40/576; 40/591

[58] Field of Search ..... 40/576, 568, 570, 574, 40/575, 582, 591

[56] References Cited

U.S. PATENT DOCUMENTS

| | | | |
|---|---|---|---|
| 1,792,517 | 2/1931 | Storms | 40/576 |
| 1,894,857 | 1/1933 | Dwyer et al. | 40/591 X |
| 3,402,493 | 9/1968 | Mellyn et al. | 40/576 X |
| 3,864,861 | 2/1975 | Hill, Jr. | 40/576 |
| 4,092,791 | 6/1978 | Apissomian | 40/576 X |
| 4,254,457 | 3/1981 | Lordier | 40/576 X |
| 4,373,284 | 2/1983 | Crane | 40/576 |
| 4,765,080 | 8/1988 | Conti | 40/576 |

FOREIGN PATENT DOCUMENTS

| | | | |
|---|---|---|---|
| 356856 | 12/1905 | France | 40/576 |
| 2140955 | 12/1984 | United Kingdom | 40/591 |

*Primary Examiner*—Laurie K. Cranmer

[57] ABSTRACT

An illuminated sign for residence street address to be connected across the terminals of the button of a house bell. The sign comprises light emitting diodes (LED) which project light on a reflector and through a plate displaying opaque digits. The LED's are constantly energized by a suitable direct current obtained by the rectification of the alternative current existing of the terminals of the house bell.

1 Claim, 3 Drawing Sheets

ILLUMINATED SIGN FOR RESIDENCE STREET ADDRESS

BACKGROUND OF THE INVENTION

Field of the invention

The invention relates to an illuminated sign and in particular to a street address sign provided with a permanent day and night illumination supplied by light emitting diodes connected to a bell circuit.

Known illuminated sign structures usually have a light source which are not considered of low intensity. They are provided with light bulbs of intensity largely sufficient to project at the desired distance. The light source is also usually directly in the line of sight behind the illustration or the digits to be displayed. Such examples appears in U.S. Pat. Nos. 2,221,887–2,298,940 and 2,624,141.

SUMMARY OF THE INVENTION

A street address sign illuminated with light emitting diodes (LED) is adapted to be connected in the circuit across the terminals of a bell, buzzer or gong of a residence. A casing which displays digits on a translucent front surface has a reflective back surface which reflects light coming from few LED's disposed along the roof of the casing. The LED's are preferably connected in series with a resistor to reduce the electric current in the bell circuit. At least one diode is connected in series with the LED's to rectify the current.

DETAILED DESCRIPTION OF THE DRAWINGS

Figure 1:
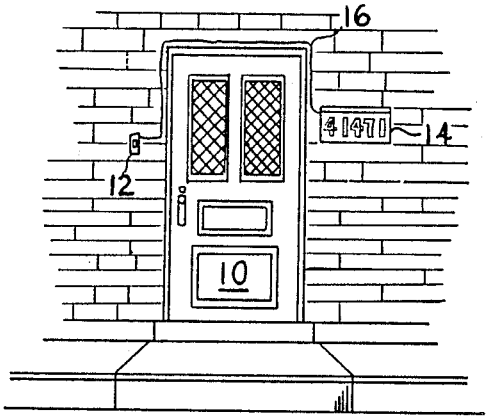
FIG. 1 is a front view of a residence door with a bell button and the address sign according to the invention.

FIG. 1 illustrates a door 10 of a residence having a bell button 12 and an illuminated residence street address sign 14 energized by the current provided at the terminal of the bell button 12. When the sign 14 is not located on the same side of the door 10 as the button 12, a small wire 16 going through bricks or around the door frame is used to make the electrical connection. Bell wires which are usually of the size no 18 can easily be dissimulated through brick, joints or around a door frame. The electricity which reaches the bell button 12 comes from a bell transformer provide a voltage between 8 and 20 volts. Such voltage is sufficient to actuate most of the bell, buzzers and chimes available.

Figure 4:
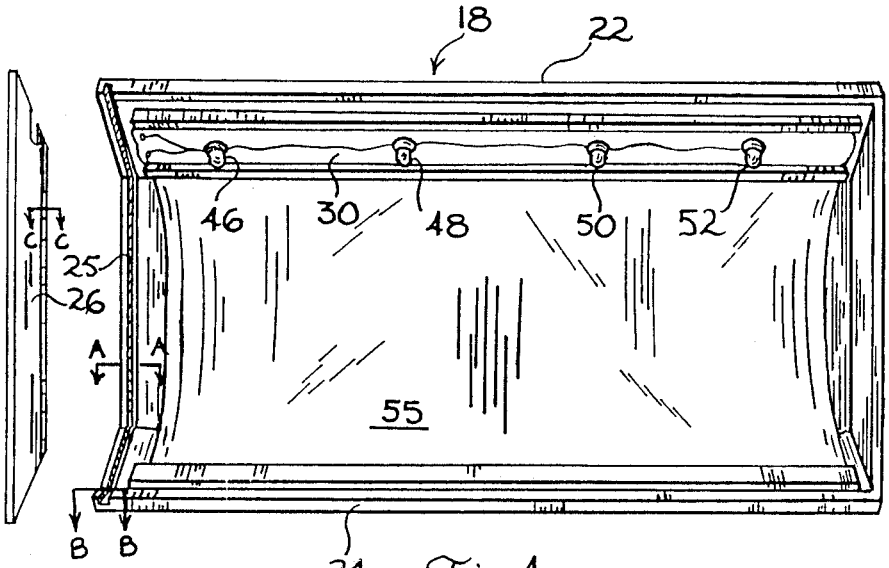
FIG. 4 is a perspective view of the casing with one end panel exploded and the front plates removed.

One purpose of this invention is to use the weak current coming from the bell button 12 and which is permanently available and to use it to illuminate constantly a residence street address sign day and night at a low cost. The sign 14 is made of a casing 18 illustrated in FIGS. 2, 3 and 4 having an elongated shallow shape. The casing 18 has a backwall 20, a roof portion 22, a bottom surface 24 and two lateral walls 26 and 28.

Figure 2:
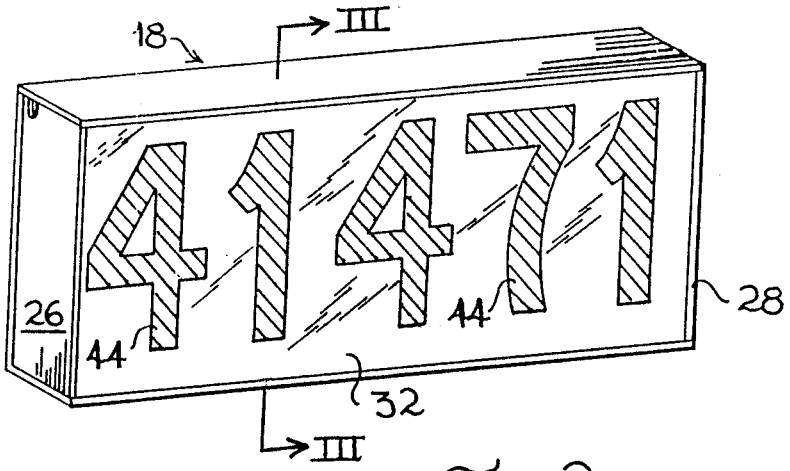
FIG. 2 is a perspective view of the casing of the address sign shown in FIG. 1.

One of the sidewalls 26 or 28 is removably mounted to provide access inside the casing 18 and for slidably mounting a circuit board 30 inside the roof portion 22 and two slidably insertable front plates 32 and 34. The leading edges 36 and 38 of the roof portion 22 and the bottom surface 24 respectively are provided with grooves 40 and 42 for allowing the sliding of the plates 32 and 34 and for closing the front of the casing 18. The plate 34 is a translucent plate having a milkiness appearance while plate 32 is made of a transparent plate having a slightly frosted surface to prevent the glare. Digits 44 such as illustrated in FIG. 2, representing the address of the residence, are made in plastic material to be held between the plates 32 and 34. The digits 44 may be made of various thin material of a relatively opaque density and may also be adapted to stick to the translucent plate. Another embodiment for displaying the digits consist in providing a completely opaque surface through which digits would be perforated.

The illumination comes from a series of adjacently position light emitting diodes (LED) 46, 48, 50 and 52. The light emitting diodes are mounted on a circuit board 30 which is slidingly inserted into grooves 54 provided in the roof portion 22. Considering that LED's have usually a relatively low intensity, the one having the highest luminous intensity are preferably selected. In particular, the LED's in which the semiconductor material is made of gallium aluminum arsenide are preferred. Furthermore, preference also exist for LED's having an integrated magnifying glass projecting light in the direction of the back plate 26. Light emitting diode lamps manufactured by the Lite-On Company in United States and having model No LTL 4268L1 have been selected. This lamp has a concentrated light distribution which can be made to project within a relatively small spatial distribution of 20° to 40°.

Figure 3:
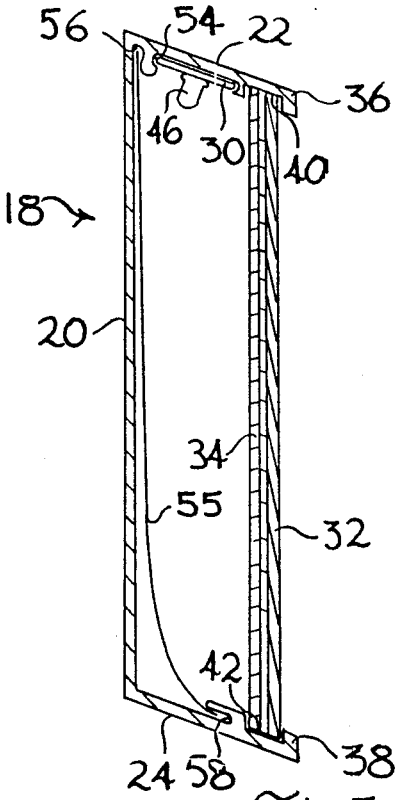
FIG. 3 is a cross-sectional view of the casing along line III—III of FIG. 2.
Figure 4A:
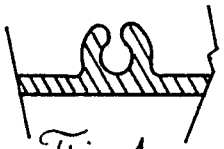
FIGS. 4*a*, 4*b* and 4*c* show cross-sectional view A—A, B—B and C—C of FIG. 4.
Figure 4B:
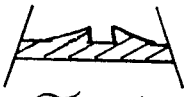
Figure 4C:
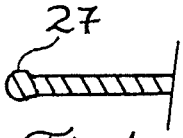

The light projected by LED's 46, 48, 50 and 52 is directed toward the bottom and back surface of the casing. In order to increase the reflection of the light towards the plate 32 and 34 and around digits 44, a mirror-like film 55 is disposed in front of the backwall 20. The film 55 has preferably a curved surface with an increased curvature near the bottom surface 24. Such a curvature is obtain by holding the top of the film in a groove 56 and the bottom of the film in groove 58, the latter being spaced from the backwall 20. As seen in FIG. 3, the rays coming from the light 46 are projected on the reflective film 54 and reflected towards the plates 32 and 34. A vertical cross-section through the mirror-like film 54 as seen in FIG. 3 having a curve corresponding to the cross-section of a paraboloid wherein the LED would be at the focal point of the paraboloid can project light, raise substantially perpendicular to the plates 32 and 34. The casing 18 is made with a removable lateral wall 26 in order to allow the sliding of the circuit board 30 in the groove 54. The mirror-like film 55 can also be slidden in grooves 56 and 58 through the side opening created by th removed of the wall 26. The wall 26 is a substantially flat plate adapted to fit and snap in groove 25 provided in the casing 18. The parts of the groove 25 in roof and bottom surfaces 22 and 24 have a square cross-section as shown in FIG. 4*b* and has a C-shape cross-section in the backwall 20 as shown in FIG. 4*a*. The back edge of the wall 26 has a bead 27 as shown in FIG. 4*c* adapted to snap into the C-shape groove. The top of the wall 26 is provided with a cut-out 29 to allow the passage of the connecting wire 16 to go from the printing board 30 to the bell 12.

Figure 6:
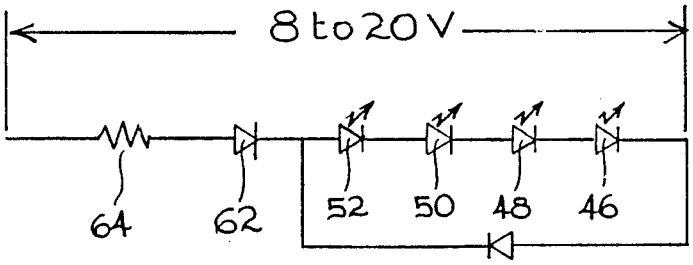
FIGS. 6 and 7 are two schematic views of two electrical circuit.
Figure 5:
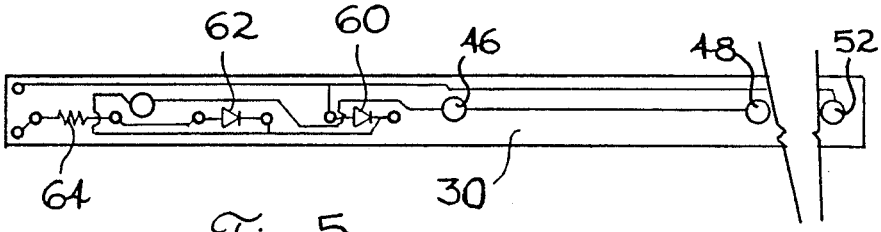
FIG. 5 is a front view of the circuit board.

FIG. 5 illustrates the printing board 30 on which the LED's 46, 48, 50 and 52 are mounted with the printed circuit including the diodes 60 and 62 and the resistor 64. The circuit on the printed board 30 is schematically illustrated in FIG. 6.

The voltage across the terminals of a switch button for a bell, a gong, a chime or the like in a residence usually varies between 8–20 volts. In order to provide an adequate current and voltage for the LED's used in the illuminated sign, a direct current is obtained with a rectifier 62 and voltage is reduced with resistor 64. To prevent possible damaging of a LED's, if a current travels in the opposite direction, when the push-button of the bell is actuated, a diode 60 is mounted in parallel with the LED's to prevent the current to travel in the direction opposite the normal direction.

Preferred LED's for such an installation are referred to as ultrabright solid state lamps and are made in United States by the Lite-On Company and distributed by ITT. The model LTL 4268LI is particularly preferred. A characteristic curve of such and LED shows a forward current of 50 mA for a voltage of 2 volts. For a set of 4 or 5 LED's the resistor 64 is chosen at about 200 ohms with ½ watt. The two diodes 60 and 62 are identified by model no IN4006 which can stop a voltage of 300 volts. Such diodes are made by the Motorola Company for a conduction of about 1 ampere. Considering the voltage and the current available, a set of 4 or 5 LED's of this type is usually adequate.

Considering that the amount of the electricity used in such a circuit and the practical permanent lifetime of the LED's, such a sign is permanently lighted except for the short period of time when the push-button 12 is actuated, in which case, the current flows to the bell, gong or the like.

Figure 7:
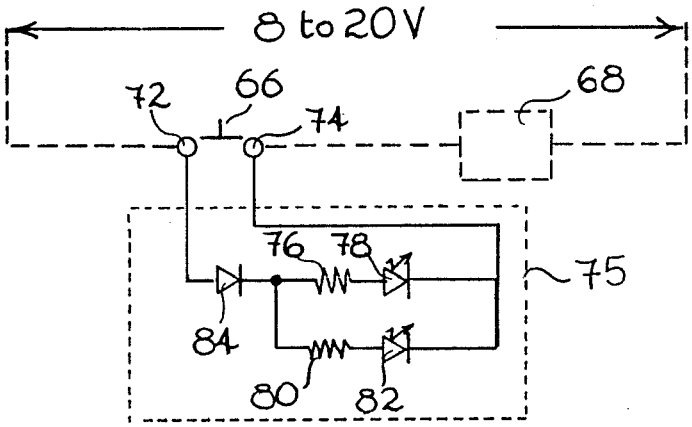

The LED's illustrated in FIG. 6 are mounted in series. However, they can equally be mounted equally in parallel such as illustrated in FIG. 7.

The push-button 66 and the bell 68 are mounted in a circuit having a difference of a potentiel between 8 and 20 volts coming from a bell transformer. The circuit 75, according to the invention, is connected to the terminals 72 and 74 of the bell push-button 66 and is accordingly continuously fed by a current the alternating current coming from the bell transformer (not shown). The current is rectified by the diode 84. A combination of two LED's 78 and 82, each connected to a resistor 76 and 80 respectively are mounted in parallel. Such an arrangement can provide results similar to the arrangement illustrated in FIG. 6 but requires a resistance for each LED in the circuit.

I claim:

1. An illuminated street address sign for residence adapted to be connected across electrical terminals of a button actuating a doorbell having a voltage of 8 to 16 volts, said sign comprising:

an elongated shallow casing, having a backwall and a roof portion forwardly extending from said backwall, said backwall being covered with a reflective surface, and said roof portion having a track tilted towards the reflective surface;

a set of juxtaposed miniature, light emitting diodes (LED) mounted adjacent said roof portion and oriented for directing light on said reflective surface, said roof portion shielding said LED from frontal projection;

a substantially flat translucent plate mounted in front of said roof portion and extending over said casing for closing the casing and enclosing the LED and said reflective surface, said translucent plate adapted to receive the light reflected from said reflective surface and to prevent glare, said plate adapted to receive substantially opaque digits on its surface for obstructing light received from the reflective surface;

a circuit board mounted in said track, said circuit board comprising a printed circuit on which the LED's are mounted in series with said terminals, at least one pair of diodes in said circuit for maintaining the current in said LED's in a unidirectional direction, said casing having a removable lateral wall, the removal of said wall adapted to free the end of said track to allow the circuit board to slide in and out of said track, whereby the circuit is constantly energized to project light through the translucent plate and adapted to be obstructed by the opaque digits.

* * * * *